US008855528B2

(12) United States Patent
Fujimura et al.

(10) Patent No.: US 8,855,528 B2
(45) Date of Patent: Oct. 7, 2014

(54) DEVELOPER TRANSPORTING MECHANISM, DEVELOPING DEVICE WITH THE SAME, AND IMAGE FORMING APPARATUS

(71) Applicant: Kyocera Document Solutions Inc., Osaka (JP)

(72) Inventors: Takeshi Fujimura, Osaka (JP); Ryoji Nishimura, Osaka (JP); Hiroaki Ohashi, Osaka (JP); Masahiro Kashimoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 18 days.

(21) Appl. No.: 13/769,653

(22) Filed: Feb. 18, 2013

(65) Prior Publication Data

US 2013/0216257 A1 Aug. 22, 2013

(30) Foreign Application Priority Data

Feb. 20, 2012 (JP) ..... 2012-033683

(51) Int. Cl.
*G03G 15/08* (2006.01)
*G03G 21/10* (2006.01)

(52) U.S. Cl.
CPC ..... *G03G 15/0839* (2013.01); *G03G 15/0886* (2013.01)
USPC ..... 399/103; 399/120; 399/257; 399/360

(58) Field of Classification Search
USPC ..... 399/103, 105, 106, 120, 257, 262, 358, 399/360
See application file for complete search history.

(56) References Cited

U.S. PATENT DOCUMENTS

| | | | | |
|---|---|---|---|---|
| 6,125,243 | A * | 9/2000 | Shoji et al. | 399/257 X |
| 7,020,428 | B2 * | 3/2006 | Park et al. | 399/360 |
| 7,890,022 | B2 * | 2/2011 | Kweon et al. | 399/120 |
| 2005/0220463 | A1 | 10/2005 | Yahagi | |
| 2009/0129826 | A1 * | 5/2009 | Koshimori et al. | 399/262 |
| 2009/0214267 | A1 * | 8/2009 | Uno | 399/257 |
| 2009/0310984 | A1 | 12/2009 | Sakatani et al. | |
| 2011/0058857 | A1 * | 3/2011 | Hori et al. | 399/262 |
| 2011/0129240 | A1 * | 6/2011 | Uno | 399/257 X |
| 2012/0033998 | A1 * | 2/2012 | Hori et al. | 399/258 |

FOREIGN PATENT DOCUMENTS

| | | |
|---|---|---|
| JP | 2001-228768 | 8/2001 |

* cited by examiner

*Primary Examiner* — Sophia S Chen
(74) *Attorney, Agent, or Firm* — K&L Gates LLP

(57) ABSTRACT

A developer transporting mechanism includes a pipe-like transporting path, sealing member, shutter, and urging member. The pipe-like transporting path, through which a developer is transported, has an discharge port at part of its side surface. The shutter is slidable along the surface of the sealing member to open and close the discharge port. The urging member urges the shutter in a direction in which the discharge port is closed. The sealing member is secured to the outer circumferential surface of the pipe-like transporting path. The sealing member also has a reduced part; its dimension in a width direction orthogonal to a direction in which the shutter moves is gradually reduced from the upstream end in the closing direction of the shutter toward the downstream end.

6 Claims, 13 Drawing Sheets

DEVELOPER TRANSPORTING MECHANISM, DEVELOPING DEVICE WITH THE SAME, AND IMAGE FORMING APPARATUS

INCORPORATION BY REFERENCE

This application is based upon, and claims the benefit of priority from, corresponding Japanese Patent Application No. 2012-033683, filed in the Japan Patent Office on Feb. 20, 2012, the entire contents of which are incorporated herein by reference.

BACKGROUND

The present disclosure relates to a developer transporting mechanism that is used in an image forming apparatus such as a copier, a printer, a facsimile machine, or a multifunctional peripheral of these devices. More particularly the disclosure relates to a mechanism that opens and closes a developer discharge port formed in a path through which a developer is transported.

Using an image forming apparatus, a latent image formed on an image supporting body including a photosensitive body and the like is developed by a developing device so that the latent image is made visible as a toner image. An example of such a developing device is a developing device that employs a two-component developing method in which a two-component developer is used. This type of developing device has a developer vessel in which the two-component developer, which includes magnetic carriers and toner, is stored. In addition, the developing device has a developing roller through which the developer is supplied to the image supporting body and also includes a stir-transport member that transports the developer from the developer vessel to the developing roller while agitating the developer.

Using a developing device employing a two-component developing method, toner is consumed in the developing operation, but carriers may remain that are not consumed. Accordingly, as carriers are more often stirred in the developer vessel together with toner, the carriers may be more deteriorated. As a result, the charging performance of the carriers to toner may be gradually reduced.

To prevent the deterioration of the charging performance of the carriers, a developing device having a developer discharge portion from which an extra amount of developer is discharged is disclosed.

A developing device having a developer discharge portion as described above, is transported in a state in which the developing device is attached in an image forming apparatus. Alternatively, a developing device having a developer discharge port is packed separately from an image forming apparatus and transported. The developer in the developer vessel may leak and may fly out from the developer discharge port due to vibration or shock during transport, so the interior of the image forming apparatus may be contaminated.

Accordingly, a shutter is used that covers the developer discharge port before the developing device is transported. When the image forming apparatus is set up, the shutter is opened and then the developing device, with open shutter, is attached to the image forming apparatus. Alternatively, after the developing device has been attached to the image forming apparatus, the shutter is opened.

When the image forming apparatus is transported in a state in which the developing device, the developer discharge port of which is opened and closed with the shutter, is attached to the image forming apparatus, the developer may leak from a clearance between the outer circumferential surface of the developer discharge portion and the inner surface of the shutter due to vibration or shock during transportation. To prevent the developer from leaking, a sealing member is provided between the outer circumferential surface of the developer discharge portion and the inner surface of the shutter. If, however, the sliding load between the shutter and the sealing member becomes large, the shutter may fail, in which case the developer discharge port may not be completely closed and thereby the developer may leak from the developer discharge port. If a sliding area between the sealing member and the shutter is reduced, the sliding load is reduced, but the sealing effect may be reduced.

The sealing member is located, for example, between the shutter and a pipe-like path through which waste toner, which has been removed from the image supporting body, is transported. As the sealing member located between the shutter and the pipe-like path is elongated in the sliding direction of the shutter, the sealing effect is improved. However, a problem arises in that the sliding resistance to the shutter is increased and the shutter is thereby not easily opened or closed. Conversely, if the length of the sealing member in the sliding direction of the shutter is shortened, the shutter can be opened and closed smoothly, but another problem arises in that a superior sealing effect cannot be achieved.

SUMMARY

A developer transporting mechanism in an embodiment of the present disclosure has a pipe-like transporting path, a sealing member, a shutter, and an urging member. The pipe-like transporting path, through which developer is transported, has a discharge port at part of its side surface. The shutter is slidable along the surface of the sealing member, opening and closing the discharge port. The urging member urges the shutter in a closing direction in which the discharge port is closed. The sealing member is secured to the outer circumferential surface of the pipe-like transporting path. The sealing member has an opening that overlaps the discharge port. The sealing member also has a reduced part; its dimension in a width direction orthogonal to a direction in which the shutter moves is gradually reduced from the upstream end in the closing direction toward the downstream end.

A developing device in another embodiment of the present disclosure has a developing vessel, a developer supply opening, a developer discharge portion, and a developer transporting mechanism. The developing vessel holds a two-component developer including carriers and toner. The developer supply opening is an opening through which the developer is supplied into the developing vessel. The developer discharge portion discharges an extra amount of developer from the developing vessel. The developer transporting mechanism has a pipe-like transporting path, a seal member, a shutter, and an urging member. The pipe-like transporting path, through which developer is transported, has a discharge port at part of its side surface. The shutter is slidable along the surface of the sealing member opening and closing the discharge port. The urging member urges the shutter in a closing direction in which the discharge port is closed. The sealing member is secured to the outer circumferential surface of the pipe-like transporting path. The sealing member has an opening that overlaps the discharge port. The sealing member also has a reduced part; its dimension in a width direction orthogonal to a direction in which the shutter moves is gradually reduced from the upstream end in the closing direction toward the downstream end.

An image forming apparatus in yet another embodiment of the present disclosure has a developer transporting mechanism. The developer transporting mechanism has a pipe-like transporting path, a sealing member, a shutter, and an urging member. The pipe-like transporting path, through which developer is transported, has a discharge port at part of its side surface. The sealing member is secured to the outer circumferential surface of the pipe-like transporting path. The sealing member has an opening that overlaps the discharge port. The shutter is slidable along the surface of the sealing member opening and closing the discharge port. The urging member urges the shutter in a closing direction in which the discharge port is closed. The sealing member also has a reduced part; its dimension in a width direction orthogonal to a direction in which the shutter moves is gradually reduced from the upstream end in the closing direction toward the downstream end.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

Additional features and advantages are described herein, and will be apparent from the following Detailed Description and the figures.

DETAILED DESCRIPTION

Figure 1:
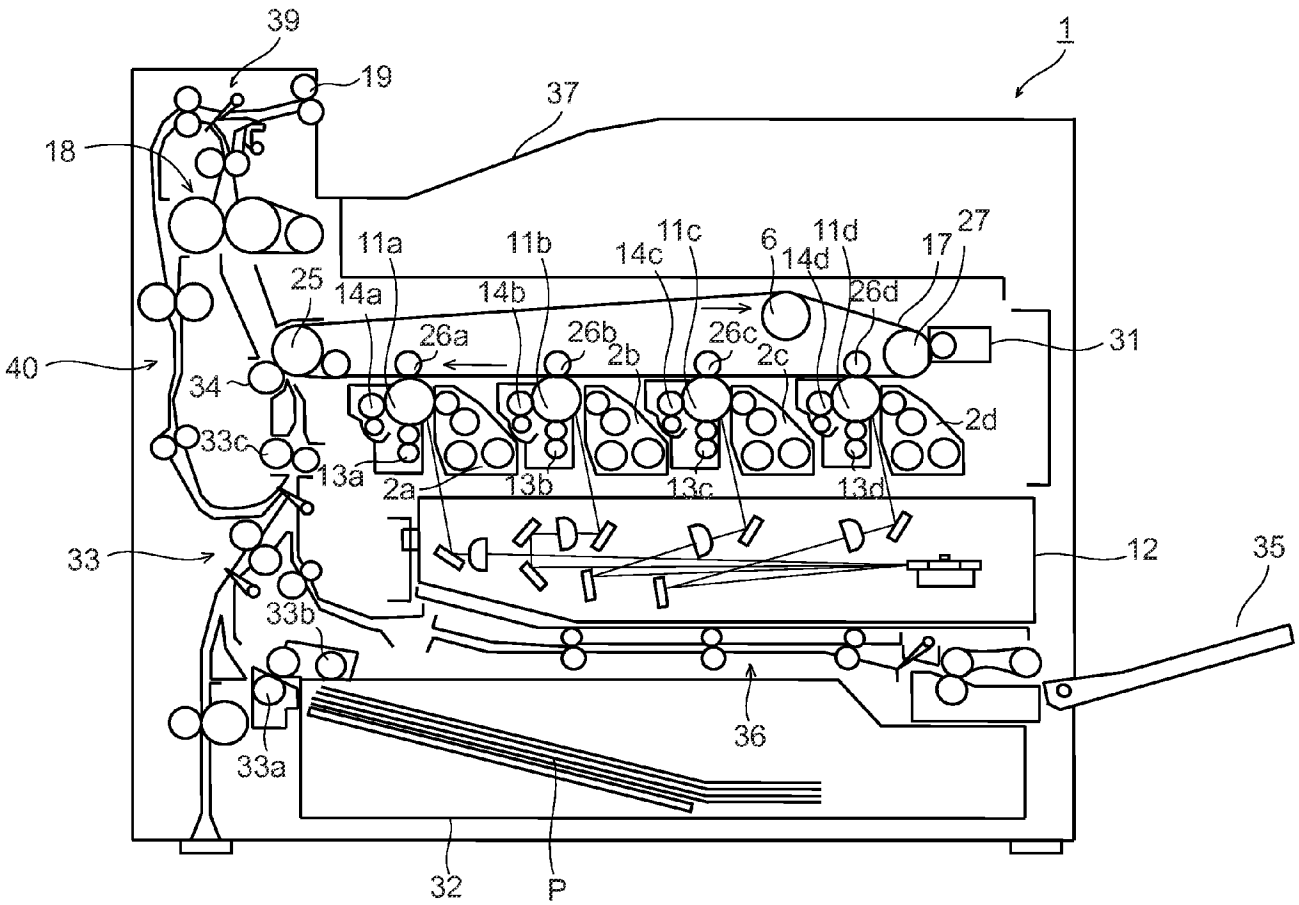
FIG. 1 is a schematic cross sectional view illustrating the structure of an image forming apparatus in an embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An embodiment of the present disclosure will be described with reference to the drawings. FIG. 1 is a schematic cross sectional view illustrating the structure of an image forming apparatus in an embodiment of the present disclosure. The image forming apparatus 1 in this embodiment is a tandem-type color printer. The image forming apparatus 1 has rotatable photosensitive drums 11*a* to 11*d*. The photosensitive drums 11*a* to 11*d* correspond to magenta, cyan, yellow, and black. Developing devices 2*a* to 2*d*, chargers 13*a* to 13*d*, and cleaning units 14*a* to 14*d* are respectively provided around the photosensitive drums 11*a* to 11*d*. An exposing unit 12 is provided around the photosensitive drums 11*a* to 11*d*.

The developing devices 2*a* to 2*d* are respectively positioned to the right of the photosensitive drums 11*a* to 11*d* in FIG. 1 so as to face them. The developing devices 2*a* to 2*d* respectively supply toner to the photosensitive drums 11*a* to 11*d*. The chargers 13*a* to 13*d* are respectively located upstream of the developing devices 2*a* to 2*d* in the rotational direction of the photosensitive drums 11*a* to 11*d* so as to face the surfaces of the photosensitive drum 11*a* to 11*d*. The chargers 13*a* to 13*d* respectively charge the surfaces of the photosensitive drums 11*a* to 11*d* uniformly.

The exposing unit 12 is located below the developing devices 2*a* to 2*d*. The exposing unit 12 performs scan exposure for the photosensitive drums 11*a* to 11*d* according to image data such as characters and pictures that has been entered into an image input part (not shown) from, for example, a personal computer. Laser beams emitted from the exposing unit 12 are directed toward the downstream of the chargers 13*a* to 13*d* on the surface of the photosensitive drums 11*a* to 11*d* in the rotational direction of the photosensitive drums 11*a* to 11*d*. Electrostatic latent images are formed on the surfaces of the photosensitive drums 11*a* to 11*d* with the emitted laser beams. These electrostatic latent images are developed to toner images by the developing devices 2*a* to 2*d*.

An intermediate transfer belt 17, which is an endless belt, is stretched on a tension roller 6, a driving roller 25, and a driven roller 27. Rotation of the driving roller 25 is provided by a motor (not shown). The intermediate transfer belt 17 is cyclically driven by rotation of the driving roller 25.

The photosensitive drums 11*a* to 11*d* are adjacently aligned along the transporting direction (indicated by the arrows in FIG. 1) below the intermediate transfer belt 17 so as to come into contact with the intermediate transfer belt 17. Primary transfer rollers 26*a* to 26*d* are respectively positioned opposite to the photosensitive drums 11*a* to 11*d* with the intermediate transfer belt 17 being located therebetween. The primary transfer rollers 26*a* to 26*d* are placed in contact with the intermediate transfer belt 17 under pressure, forming a primary transfer part. In the primary transfer part, as the intermediate transfer belt 17 rotates, the toner images on the photosensitive drums 11*a* to 11*d* are sequentially transferred to the intermediate transfer belt 17 on a prescribed timing. Thus, toner images in four colors, magenta, cyan, yellow and black, are overlaid on the surface of the intermediate transfer belt 17, forming a full-color toner image.

A secondary transfer roller 34 is provided opposite the driving roller 25 with the intermediate transfer belt 17 being located therebetween. The secondary transfer roller 34 is placed in contact with the intermediate transfer belt 17 under pressure, forming a secondary transfer part. In the secondary transfer part, the toner image on the surface of the intermediate transfer belt 17 is transferred to paper P. After the toner mage has been transferred, a belt cleaning unit 31 removes toner remaining on the intermediate transfer belt 17.

A paper feed cassette 32, where paper sheets P are stacked, is positioned at the bottom of the interior of the image forming apparatus 1. A stack tray 35, from which paper is manually supplied, is located to the right of the paper feed cassette 32. A first paper conveying path 33 is located to the left of the paper feed cassette 32. The paper P fed from the paper feed cassette 32 is fed through the first paper conveying path 33 to the secondary transfer part of the intermediate transfer belt 17. A second paper conveying path 36 is located to the left of the stack tray 35. The paper fed from the stack tray 35 is fed through the second paper conveying path 36 to the secondary transfer part. Furthermore, a fixing part 18 and a third paper conveying path 39 are located at the upper-left corner of the image forming apparatus 1; the fixing part 18 performs fixing processing for the paper P on which an image has been formed and the third paper conveying path 39 feeds the paper that has undergone fixing processing to a paper ejection part 37.

The paper feed cassette 32 has a pickup roller 33*b* and a separation roller 33*a*, by which the paper sheets P in the paper feed cassette 32 are fed to the first paper conveying path 33 a sheet at a time.

The first paper conveying path 33 and second paper conveying path 36 join in front of a resistance roller pair 33*c*. The resistance roller pair 33*c* is used to feed the paper P to the secondary transfer part at a correct timing between a paper supply operation and an image formation operation on the intermediate transfer belt 17. After the paper P has been fed to the secondary transfer part, the full color toner image on the intermediate transfer belt 17 is secondarily transferred to the paper P by the secondary transfer roller 34, to which a bias voltage has been applied. The paper P is then fed to the fixing part 18.

The fixing part 18 heats and pressurizes the paper P, to which the toner image has been transferred, to fix the toner image. After the toner image has been fixed onto the paper P by the fixing part 18, the paper P is inverted on a fourth paper conveying path 40 as necessary so that the toner image is secondarily transferred to the back of the paper P as well by the secondary transfer roller 34, after which the toner image is fixed by the fixing part 18. The paper P, onto which the toner image has been fixed, passes through the third paper conveying path 39 is ejected to the paper ejection part 37 by an ejection roller pair 19.

Figure 2:
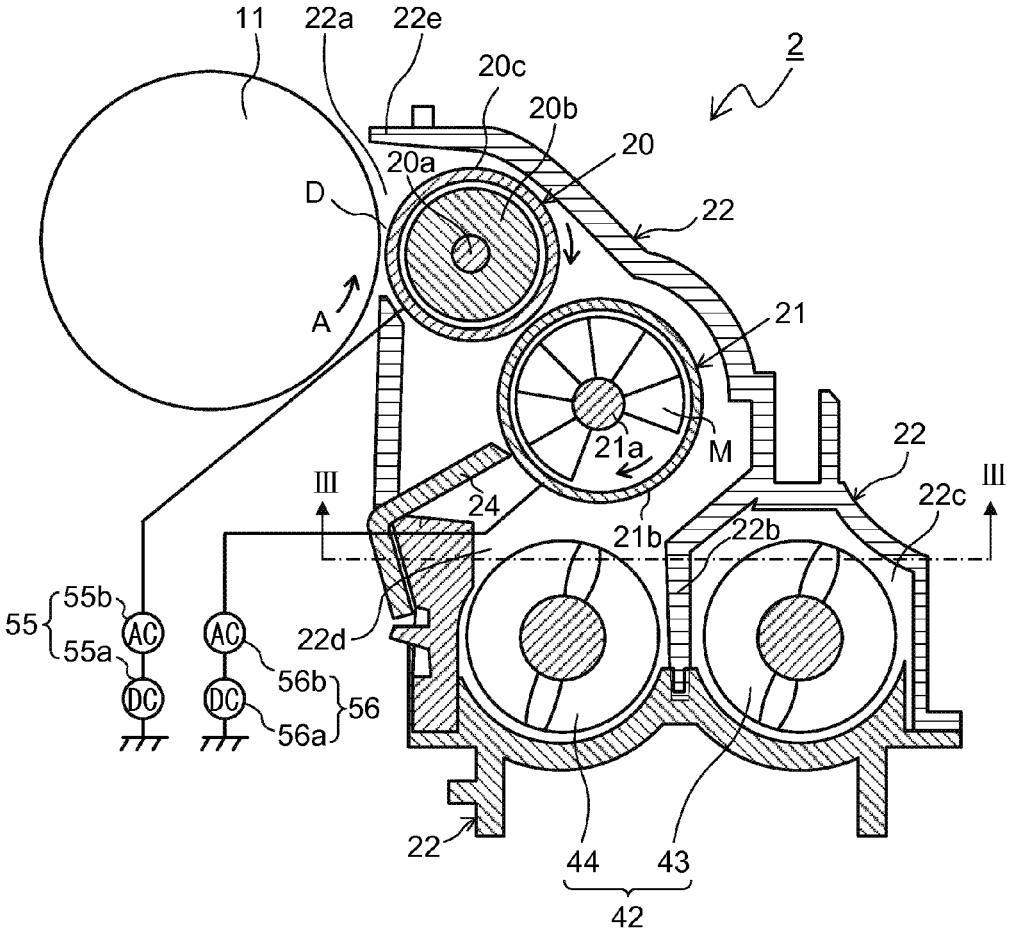
FIG. 2 is a cross sectional view of a side of a developing device included in the image forming apparatus in an embodiment of the present disclosure.

FIG. 2 is a cross sectional view illustrating the structure of a developing device 2, which has an embodiment of the developer transporting mechanism of the present disclosure and is used in the image forming apparatus 1 described above. The structure and operation of the developing device 2*a* illustrated in FIG. 1, which corresponds to the photosensitive drum 11*a*, will be described. Since the developing devices 2*b* to 2*d* have the same structure as the developing device 2*a* and operate in the same way as the developing device 2*a*, explanations of their structures and operations will be omitted. The reference characters "a" to "d" assigned to the developing devices and photosensitive bodies in individual colors will also be omitted hereinafter.

As illustrated in FIG. 2, the developing device 2 includes a developing roller 20, a magnetic roller 21, a restricting blade 24, a stir-transport member 42, and a developer vessel 22.

The developer vessel 22, which forms the exterior of the developing device 2, has a first transporting chamber 22*c* and a second transporting chamber 22*d*, which are divided at the bottom by a dividing part 22*b*. The first transporting chamber 22*c* and second transporting chamber 22*d* hold a developer including carriers and toner. The developer vessel 22 rotatably retains the stir-transport member 42, magnetic roller 21, and developing roller 20. The developer vessel 22 also has an opening 22*a* through which the developing roller 20 is exposed toward the photosensitive drum 11.

The developing roller 20 is located to the right of the photosensitive drum 11 so as to face the photosensitive drum 11 with a fixed space left therebetween. The developing roller 20 has a developing area D from which toner is supplied to the photosensitive drum 11, the developing area D being located near to the surface of the photosensitive drum 11 so as to face it. The magnetic roller 21 is located to the lower right of the developing roller 20 so as to face the developing roller 20. The magnetic roller 21 supplies toner to the developing roller 20 at a position near the developing roller 20 at which the magnetic roller 21 faces the developing roller 20. The stir-transport member 42 is located substantially below the magnetic roller 21. The restricting blade 24 is secured to the developer vessel 22 and retained to the lower left of the magnetic roller 21.

The stir-transport member 42 includes a first spiral 43 and a second spiral 44. The second spiral 44 is located below the magnetic roller 21 and in the second transporting chamber 22*d*. The first spiral 43 is located to the right of the second spiral 44 and in the first transporting chamber 22*c*.

The first spiral 43 and second spiral 44 stir the developer to charge the toner in the developer to a prescribed level. Thus, toner is retained by the carriers. Communicating parts (not shown in FIG. 2) are formed at both ends of the dividing part 22*b*, which divides the developer vessel 22 into the first transporting chamber 22*c* and second transporting chamber 22*d*, in the longitudinal direction (front-to-back direction in of FIG. 2). When the first spiral 43 rotates, the charged developer is transported from the first transporting chamber 22*c* through the communicating part formed at one end of the dividing part 22*b* to the second transporting chamber 22*d* and is also transported from the second transporting chamber 22*d* through the communicating part formed at the other end of the dividing part 22*b* to the first transporting chamber 22*c*, enabling the developer to circulate between the interior of the first transporting chamber 22*c* and the interior of the second transporting chamber 22*d*. Developer is supplied from the second transporting chamber 22*d* to the magnetic roller 21.

The magnetic roller 21 has a roller axis 21*a*, a magnetic pole member M, and a non-magnetic sleeve 21*b* made of a non-magnetic material. The magnetic roller 21 supports the developer supplied by the stir-transport member 42 and supplies only the toner of the supported developer to the developing roller 20.

When the non-magnetic sleeve 21*b* rotates, a magnetic brush is supported on the surface of the non-magnetic sleeve 21*b* by the magnetic pole member M and is transported. When the magnetic brush comes into contact with the developing roller 20, only toner on the magnetic brush is supplied to the developing roller 20. The amount of toner supplied from the magnetic brush to the developing roller 20 depends on the bias 56 applied to the non-magnetic sleeve 21*b*.

The developing roller 20 includes a fixed axis 20*a*, a magnetic pole member 20*b*, and a developing sleeve 20*c* that is made of a non-magnetic metal material in a cylindrical shape.

When the developing sleeve 20*c*, to which a developing bias 55 has been applied, rotates clockwise in FIG. 2, toner supported on the surface of the developing sleeve 20*c* flies to the photosensitive drum 11 in the developing area D due to a difference between the potential of the developing bias and the potential at the exposed part of the photosensitive drum 11. The toner that has moved to the photosensitive drum 11 sequentially adheres to the exposed part of the photosensitive drum 11, which is rotating in the direction indicated by the arrow A in FIG. 2 (counterclockwise direction), so the electrostatic latent image on the photosensitive drum 11 is developed.

Figure 3:
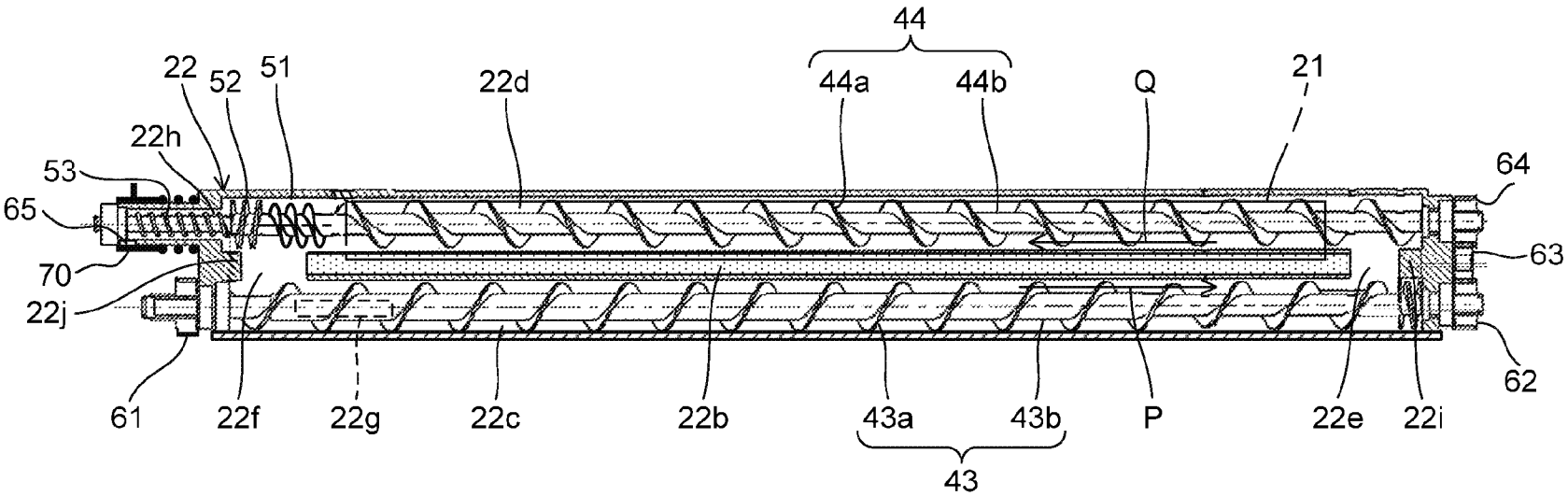
FIG. 3 is a cross sectional view of the plane of an agitating unit included in the developing device in an embodiment of the present disclosure.

Next, the agitating unit of the developing device will be described in detail with reference to FIG. 3. FIG. 3 is cross sectional view of the plane of the agitating unit included in the developing device 2 (cross sectional view as taken along in FIG. 2).

In addition to the first transporting chamber 22*c*, second transporting chamber 22*d*, and dividing part 22*b*, the developer vessel 22 includes an upstream communicating part 22*e*, a downstream communicating part 22*f*, a developer supply port 22*g*, a developer discharge portion 22*h*, an upstream wall 22*i*, and a downstream wall 22*j*. In the first transporting chamber 22*c*, the left side in FIG. 3 is on the upstream side and the right side in FIG. 3 is on the downstream side. In the second transporting chamber 22*d*, the right side in FIG. 3 is on the upstream side and the left side in FIG. 3 is on the downstream side. Accordingly, the communicating part and wall are referred to as the upstream or downstream communication part and upstream or downstream wall with respect to the second transporting chamber 22*d*.

The dividing part 22*b*, which extends in the longitudinal direction of the developer vessel 22, divides the developer vessel 22 into the first transporting chamber 22*c* and second transporting chamber 22*d* so as to make them parallel to each other. The right end of the dividing part 22*b* in the longitudinal direction forms the upstream communicating part 22*e* together with the inner surface of the upstream wall 22*i*. The left end of the dividing part 22*b* in the longitudinal direction forms the downstream communicating part 22*f* together with the inner surface of the downstream wall 22*j*. Thus, developer can circulate between the first transporting chamber 22*c* and the second transporting chamber 22*d* through the upstream communicating part 22*e* and downstream communicating part 22*f*.

The developer supply port 22*g* is an opening, which is formed on the upstream side of the first transporting chamber 22*c* (left side in FIG. 3), through which new toner and new carriers are replenished from a developer supply vessel (not shown) positioned at the top of the developer vessel 22 into the interior of the developer vessel 22.

The developer discharge portion 22*h* discharges an extra amount of developer, that is surplus in the first transporting chambers 22*c* and 22*d* as a result of the replenishing new developer. The developer discharge portion 22*h* includes a pipe-like transporting path that is cylindrically located continuously on the downstream side of the second transporting chamber 22*d* in the longitudinal direction of the second transporting chamber 22*d*.

The first transporting chamber 22*c* includes the first spiral 43 and the second transporting chamber 22*d* includes the second spiral 44.

The first spiral 43 has a rotational axis 43*b* and a first spiral vane 43*a*, which is integrally formed with the rotational axis 43*b* in a spiral form in the axial direction of the rotational axis 43*b* at a fixed pitch. The rotational axis 43*b* is rotatably supported by the upstream wall 22*i* and downstream wall 22*j* of the developer vessel 22.

The second spiral 44 has a rotational axis 44*b* and a second spiral vane 44*a*, which is integrally formed with the rotational axis 44*b* in a spiral form in the axial direction of the rotational axis 44*b* at the same pitch as the pitch of the first spiral vane 43*a*; however, the second spiral vane 44*a* is oriented in a direction opposite to the direction in which the first spiral vane 43*a* is oriented, that is the second spiral vane 44*a* has a phase opposite to the phase of the first spiral vane 43*a*. The rotational axis 44*b* is located parallel to the rotational axis 43*b* and is rotatably supported by the upstream wall 22*i* and downstream wall 22*j* of the developer vessel 22.

The rotational axis 44*b* is integrally formed with not only the second spiral vane 44*a*, but also a low-speed transport portion 51, a restricting part 52, and an discharging vane 53.

The low-speed transport portion 51 has a plurality of spiral vanes (three vanes in FIG. 3), which are oriented in the same direction as the second spiral vane 44*a*. The outer diameter of each spiral vane of the low-speed transport portion 51 is the same as the outer diameter of the second spiral vane 44*a*. The pitch of the spiral vanes of the low-speed transport portion 51 is less than the pitch of the second spiral vane 44*a*. At least part of the spiral vanes of the low-speed transport portion 51 faces the downstream communicating part 22*f*.

The restricting part 52 holds back the developer transported downstream in the second transporting chamber 22*d*. If the amount of developer is increased to or above a prescribed level, the restricting part 52 enables an extra amount of developer to be transported to the developer discharge portion 22*h*. The restricting part 52 has spiral vanes, formed around the rotational axis 44*b*, that are oriented in a direction opposite to the direction in which the second spiral vane 44*a* is oriented, that is the spiral vanes have a phase opposite to the phase of the second spiral vane 44*a*. The outer diameter of the restricting part 52 is substantially the same as the outer diameter of the second spiral vane 44*a*. The pitch of the restricting part 52 is less than the pitch of the second spiral vane 44*a*. A fixed space is left between the outer circumference of the restricting part 52 and the inner walls of the downstream wall 22*j* and other parts in the developer vessel 22. The extra amount of developer is discharged from this space.

The rotational axis 44*b* extends to the interior of the developer discharge portion 22*h*. The rotational axis 44*b* in the developer discharge portion 22*h* has the discharging vane 53. The discharging vane 53 is oriented in the same direction as the second spiral vane 44*a*. The pitch of the discharging vane 53 is less than the pitch of the second spiral vane 44*a*. The outer diameter of the discharging vane 53 is less than the outer diameter of the second spiral vane 44*a*. When the rotational axis 44*b* rotates, therefore, the discharging vane 53 also rotates and the extra amount of developer, which has proceeded over the restricting part 52 and has been transported to the interior of the developer discharge portion 22*h*, is delivered to the left side in FIG. 3 and is discharged to the outside of the developer vessel 22. The discharging vane 53, restricting part 52, and second spiral vane 44*a*, which are all made of synthetic resins, are integrally formed with the rotational axis 44*b*.

At the bottom of the developer discharge portion 22*h*, an discharge port 65 is formed, which communicates with linkage parts 82*a* to 82*d* (see FIG. 6) of a transporting pipe 82. A shutter 70, which opens and closes the discharge port 65, is attached to the outer circumference of the pipe-like transporting path of the developer discharge portion 22*h*.

Gears 61 to 64 are located on outer walls of the developer vessel 22. The gears 61 and 62 are secured to the first spiral vane 43*a*, and the gear 64 is secured to the rotational axis 44*b*. The gear 63 is rotatably retained by the developer vessel 22 and engages the gears 62 and 64.

Figure 4:
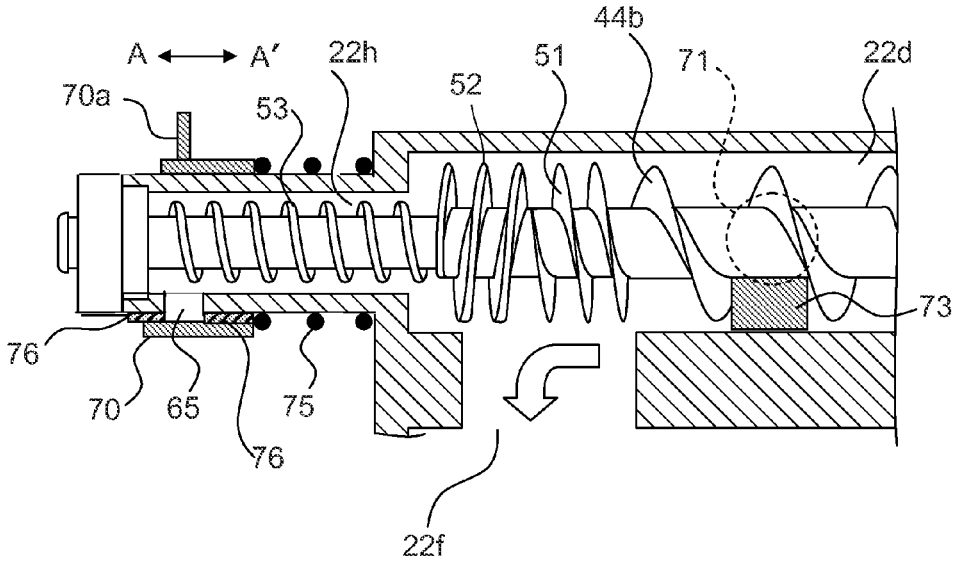
FIG. 4 is an enlarged view around a developer discharge portion illustrated in FIG. 3.

FIG. 4 is an enlarged view around the developer discharge portion 22*h* illustrated in FIG. 3. In the second spiral 44, the low-speed transport portion 51 is located upstream (right side in FIG. 4) of the restricting part 52 in the developer transporting direction (indicated by the white arrow in FIG. 4) so as to face the downstream communicating part 22*f*.

In this structure, when the rotational axis 44*b* rotates, the second spiral vane 44*a* causes the developer to be transported relatively fast in the second transporting chamber 22*d*. Since the low-speed transport portion 51 has a smaller pitch than the second spiral vane 44*a*, however, the transporting speed of the developer in an area, in the second transporting chamber 22*d*, in which the low-speed transport portion 51 is located becomes less than the transporting speed caused by the second spiral vane 44*a*. Specifically, when the developer is transported in an area, in the second transporting chamber 22*d*, in which the second spiral vane 44*a* is located, the developer moves relatively fast while largely changing its bulk because the pitch of the spiral vanes is relatively large. When the developer is transported in the area, in the second transporting chamber 22*d*, in which the low-speed transport portion 51 is located, however, the developer slowly moves while changing its bulk on a small scale because the pitch of spiral vanes is relatively small.

Accordingly, while in development and new developer is not replenished, when the gear 61 is rotated by a driving source such as a motor, the first spiral 43 rotates together with the rotational axis 43*b* and the developer is transported in the first transporting chamber 22*c* by the first spiral vane 43*a* in the direction indicated by the arrow P (see FIG. 3), after which the developer passes through the upstream communicating part 22*e* and is transported to the interior of the second transporting chamber 22*d*. Furthermore, when the second spiral vane 44*a* rotates together with the rotational axis 44*b*, which rotates together with the rotational axis 43*b*, the developer in the second transporting chamber 22*d* is moved by the second spiral vane 44*a* in the direction indicated by the arrow Q (see FIG. 3) and is thereby transported to the low-speed transport portion 51.

When the first spiral vane 43*a* and second spiral vane 44*a* rotate, the developer is transported relatively fast while largely changing its bulk. In the vicinity of the low-speed transport portion 51, however, changes in the bulk of the developer are relatively small and the developer is slowly transported. Accordingly, even when the developer strikes against the restricting part 52, the developer does not splash, suppressing the developer from proceeding over the outer circumference of the restricting part 52. As a result, the developer passes through the downstream communicating part 22*f* and is transported to the first transporting chamber 22*c* without proceeding over the restricting part 52.

As described above, the developer is stirred while being circulated from the first transporting chamber 22*c* through the upstream communicating part 22*e*, second transporting chamber 22*d*, and downstream communicating part 22*f*. The stirred developer is supplied to the magnetic roller 21.

Next, the situation when the developer is replenished from the developer supply port 22*g* will be described. When toner is consumed during development, a new developer including carriers is replenished from the developer supply port 22*g* into the interior of the first transporting chamber 22*c*.

The replenished developer is transported in the interior of the first transporting chamber 22*c* by the first spiral vane 43*a* in the direction indicated by the arrow P (see FIG. 3), as in the case of development, after which the developer passes through the upstream communicating part 22*e* and is transported to the interior of the second transporting chamber 22*d*. The developer in the second transporting chamber 22*d* is further transported by the second spiral vane 44*a* in the direction indicated by the arrow Q (see FIG. 3) and is thereby transported to the low-speed transport portion 51. When the restricting part 52 rotates, due to the rotation of the rotational axis 44*b*, the restricting part 52 applies a transporting force to the developer in a direction opposite to the direction in which the developer is transported by the second spiral vane 44*a*, reducing the transporting speed of the developer. The developer having its transporting speed reduced in the low-speed transport portion 51 is blocked in the vicinity of the low-speed transport portion 51 positioned upstream of the restricting part 52, increasing the bulk of the developer. Accordingly, an extra amount of developer (substantially the same as the amount of developer replenished from the developer supply port 22*g*) proceeds over the restricting part 52 and is then discharged through the developer discharge portion 22*h* to the outside of the developer vessel 22.

In the second transporting chamber 22*d*, a toner density sensor 71 is adjacently located upstream of the low-speed transport portion 51 in the developer transporting direction (indicated by the white arrow in FIG. 4). Since, in FIG. 4, the second spiral 44 is positioned in front of the toner density sensor 71 in the drawing sheet, the toner density sensor 71 is indicated by a dashed line.

As the toner density sensor 71, a magnetic permeability sensor, which senses the magnetic permeability of the developer in the developer vessel 22, may be used. When the magnetic permeability of the developer is sensed by the toner density sensor 71, a control unit determines the density of the toner from an output value of the toner density sensor 71.

The output value of the sensor changes depending on the toner density. The higher the toner density is, the higher the ratio of the amount of toner to the amount of carriers is; since the ratio of the amount of toner, through which magnetism cannot pass, is increased, the output value becomes low. By contrast, the lower the toner density is, the lower the ratio of the amount of toner to the amount of carriers is; since the ratio of the amount of carriers, through which magnetism can pass, is increased, the output value becomes high.

In the second spiral 44, a scraper 73 is also provided at a position corresponding to the toner density sensor 71. When the scraper 73 rotates due to the rotation of the rotational axis 44*b*, the sensing surface of the toner density sensor 71 is scraped and cleaned and the developer is more likely to stay at a portion at which the sensor is located.

The shutter 70 is a cylindrical member that is slidable on the developer discharge portion 22*h* in the axial direction (indicated by the arrows A and A' in FIG. 4). A projection 70*a* is formed on the outer surface of the shutter 70. A coil spring 75 is located between the shutter 70 and the developing roller 20. The shutter 70 is urged by the coil spring 75 in a closing direction (indicated by the arrow A in FIG. 4). Usually, the shutter 70 is located at a portion at which the shutter 70 covers the discharge port 65 of the developer discharge portion 22*h* as illustrated in FIG. 4, closing the discharge port 65.

A sealing member 76 is located between the outer circumferential surface of the developer discharge portion 22*h* and the inner circumferential surface of the shutter 70 along the outer circumferential portion of the discharge port 65, preventing the developer from leaking from the clearance between the developer discharge portion 22*h* and the shutter 70. The developer discharge portion 22*h*, shutter 70, coil spring 75, and sealing member 76 constitute the developer transporting mechanism in the present disclosure.

Figure 5:
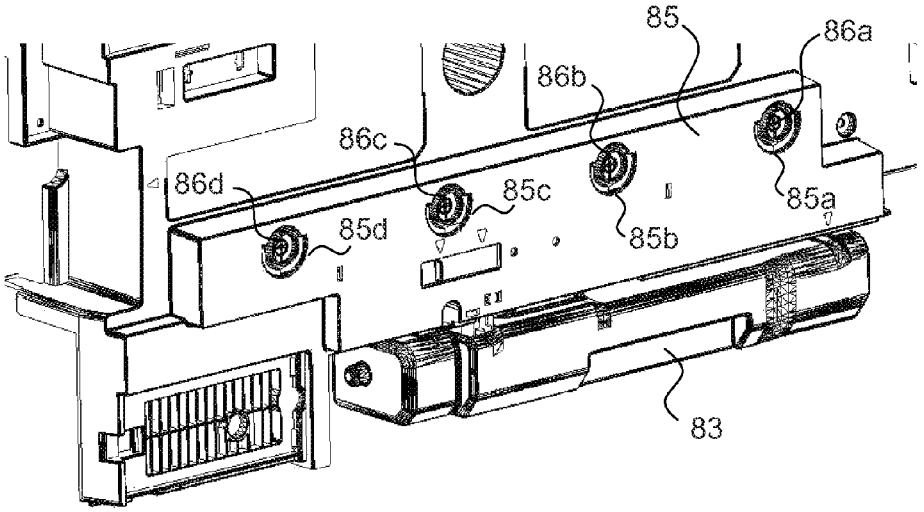
FIG. 5 is a partial perspective view illustrating the image forming apparatus when the external cover on the front side is open in an embodiment of the present disclosure.
Figure 6:
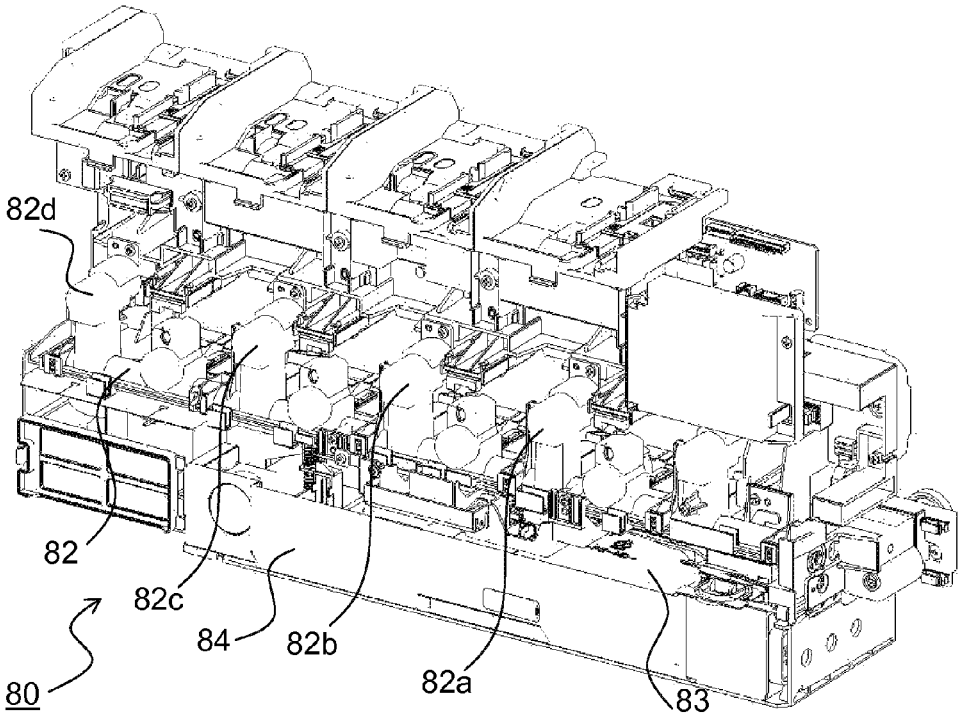
FIG. 6 is a perspective view illustrating the inner cover illustrated in FIG. 5 removed to expose the developer collecting mechanism.
Figure 7:
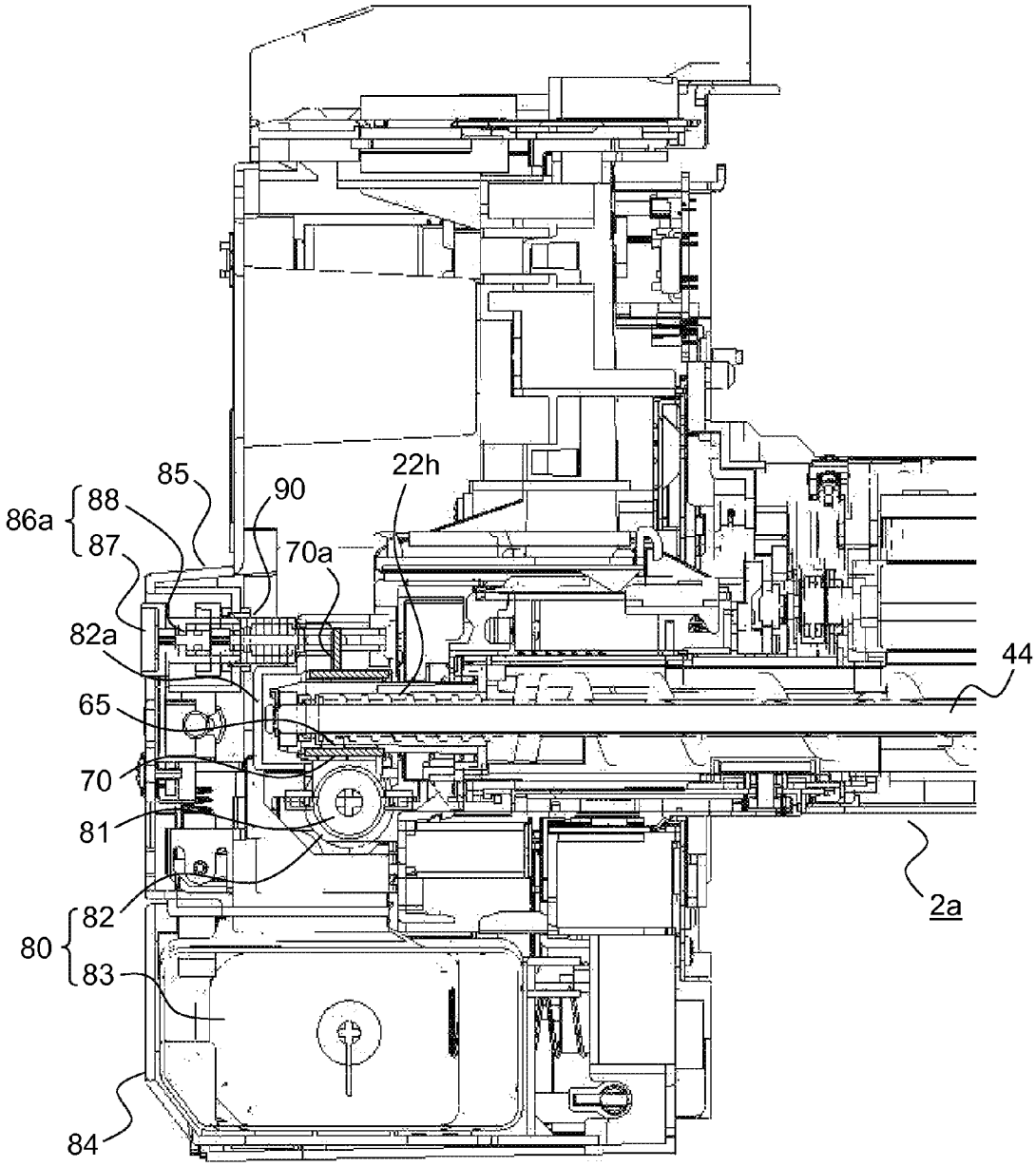
FIG. 7 is a cross sectional view of the developer collecting mechanism when the discharge port is closed by a shutter.

FIG. 5 is a partial perspective view illustrating a state in which an external cover (not shown) on the front side of the image forming apparatus is open. FIG. 6 is a perspective view illustrating the inner cover 85 in FIG. 5 removed to expose a developer collecting mechanism. FIG. 7 is a cross sectional view of a side of the developer collecting mechanism. In FIG. 6, the developing devices 2*a* to 2*d* are not shown. The cross section in FIG. 7 is taken at a position corresponding to the developing device 2*a*.

The developer collecting mechanism 80 has a transporting pipe 82 in which a transporting screw 81 is located, and also includes a collecting vessel 83 in which the developer that has been transported through the transporting pipe 82 is stored. The collecting vessel 83 is included in a drawable tray 84 (not shown in FIG. 5). The transporting pipe 82 has connecting parts 82*a* to 82*d*, which are respectively connected to the developer discharge portion 22*h* (see FIG. 4) of the developing devices 2*a* to 2*d*.

Pressing parts 86*a* to 86*d* are respectively located at positions corresponding to the shutter 70 of the developing devices 2*a* to 2*d*. The pressing parts 86*a* to 86*d*, each of which is shaped like a screw, are each formed with a head 87 and an axis 88. The axis 88 passes through a through-hole 90 formed in the case of the image forming apparatus 1 and abuts the projection 70*a* of the shutter 70. The inner cover 85 has windows 85*a* to 85*d*, through which the heads 87 of the pressing parts 86*a* to 86*d* are respectively exposed. Each of the pressing parts 86*a* to 86*d* is pressed toward the inner cover 85 (in the direction indicated by the arrow A in FIG. 4) by the projection 70*a* of the shutter 70 urged by the coil spring 75 (see FIG. 4).

FIGS. 5 to 7 illustrate states before the image forming apparatus 1 is shipped; in a state in which the developing device 2*a* has been attached to the image forming apparatus 1, the discharge port 65 of the developer discharge portion 22*h* is closed by the shutter 70 as illustrated in FIG. 7. Therefore, even when the image forming apparatus 1 is transported in this state, there is no fear that the developers, with which the developing devices 2*a* to 2*d* are filled, will leak from the discharge ports 65 due to vibration or shock caused during transportation.

Figure 8A:
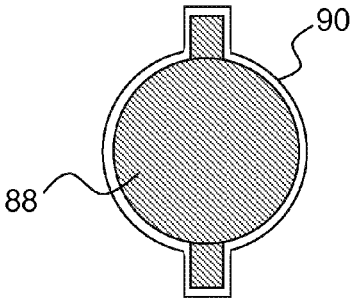
FIGS. 8A and 8B schematically illustrate the relationship between the axis of pressing members and a through-hole formed in the case of the developer collecting mechanism.
Figure 8B:
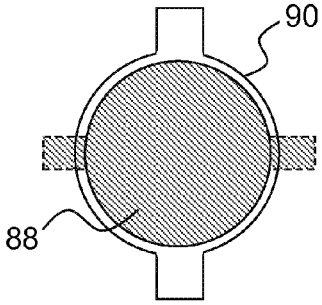

After having been delivered to the user, the image forming apparatus 1 is set up (initialized) by a serviceman. In this setup, a screwdriver is inserted into the head 87 of each of the pressing parts 86*a* to 86*d* and is rotated to push the pressing part into the inner cover 85. The axis 88 and through-hole 90 of each of the pressing parts 86*a* to 86*d* have a relationship between a key and a key hole as illustrated in FIG. 8A. When the axis 88 is inserted into the through-hole 90 and is rotated by 90 degrees as illustrated in FIG. 8B, therefore, the pressing parts 86*a* to 86*d* are secured at the positions up to which they have been pushed.

Figure 9:
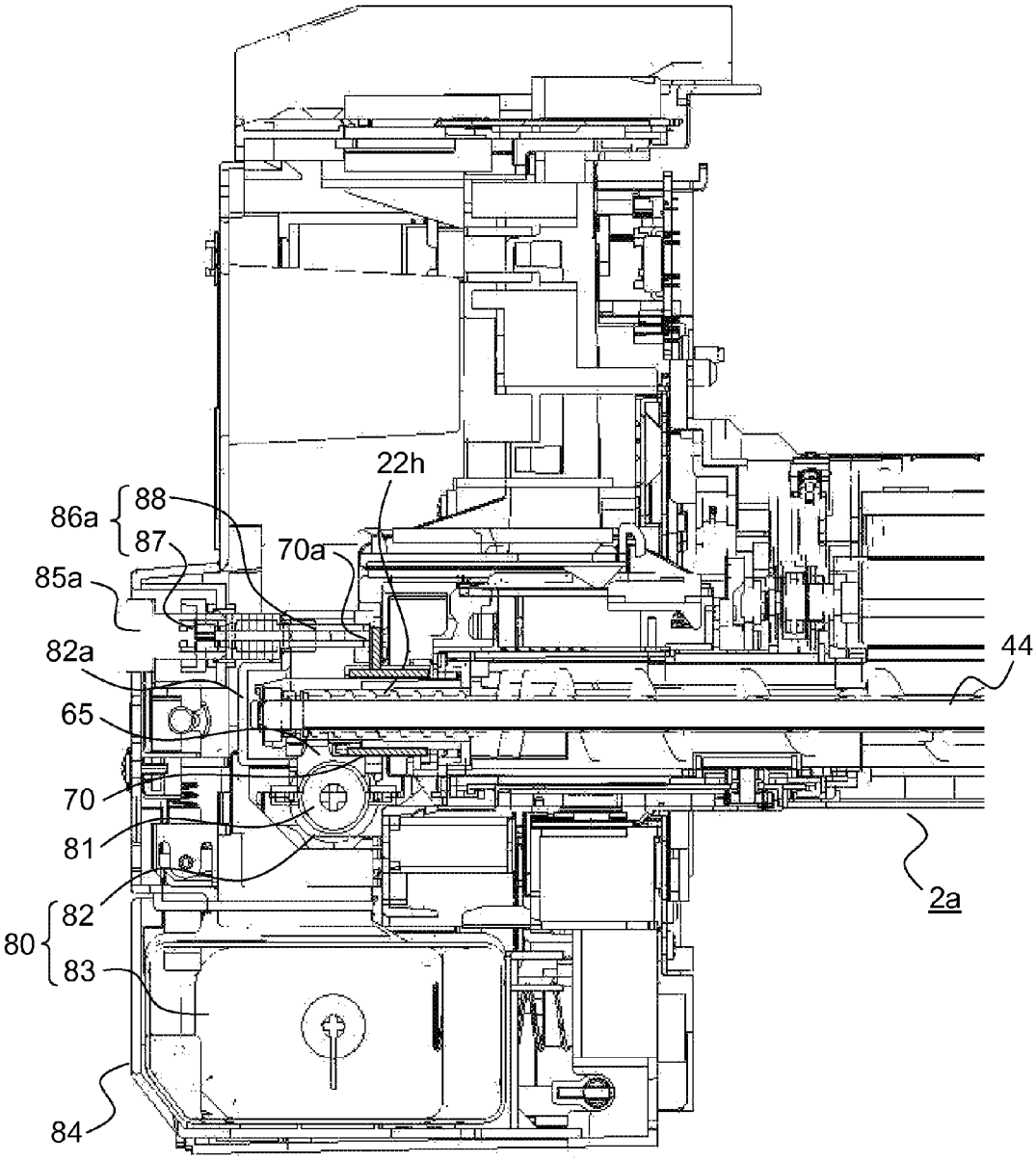
FIG. 9 is a cross sectional view of a side of the developer collecting mechanism when the discharge port is opened by the shutter.
Figure 10:
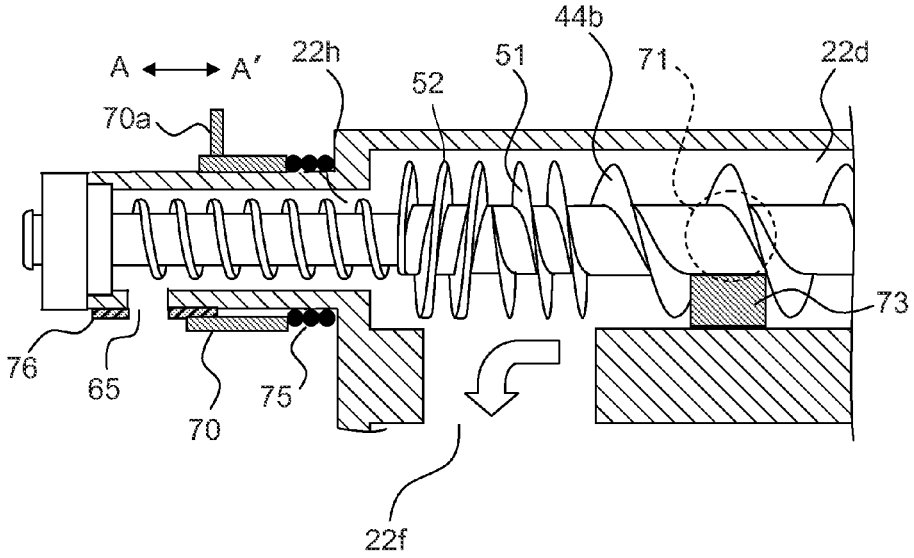
FIG. 10 is an enlarged view around the developer discharge portion illustrated in FIG. 9.

FIG. 9 is a cross sectional view of a side of the developer collecting mechanism, illustrating a state in which the discharge port 65 has been opened by the shutter 70. FIG. 10 is an enlarged view around the developer discharge portion 22*h* illustrated in FIG. 9. As illustrated in FIGS. 9 and 10, when the pressing parts 86*a* to 86*d* are pushed into the inner cover 85, the projection 70*a* of the shutter 70 is pressed against the axis 88 of the pressing parts 86*a* to 86*d* and the shutter 70 moves in the direction indicated by the arrow A' (see FIG. 4) while compressing the coil spring 75, opening the discharge port 65. Thus, the discharge port 65 of the developer discharge portion 22*h* and the transporting pipe 82 mutually communicate, enabling the developer to be discharged from the discharge port 65. The developer discharged from the discharge port 65 of the developer discharge portion 22*h* is transported through the transporting pipe 82 by the transporting screw 81 and is stored in the collecting vessel 83.

The simple structure in this embodiment makes it possible to reliably prevent the interior of the image forming apparatus 1 from being contaminated by leakage of the developer from the developer discharge portion 22*h*, which would otherwise be caused when the image forming apparatus 1 is transported (shipped) with the developing devices 2*a* to 2*d* filled with developer. When the image forming apparatus 1 is set up, the discharge port 65 can be opened with a simple operation.

Next, the relationship between the sealing member 76 and operations to open and close the shutter 70, which are performed to remove the developing devices 2*a* to 2*d* from the image forming apparatus 1, will be described. First, a screwdriver is inserted into the head 87 of the pressing parts 86*a* to 86*d* and is rotated by 90 degrees to change the state of the pressing parts 86*a* to 86*d* in FIG. 8B to the state in FIG. 8A. The pressing parts 86*a* to 86*d* are then pushed back toward the inner cover 85 by the restoration force of the compressed coil spring 75 and the shutter 70 is moved in the direction indicated by the arrow A (see FIG. 4), closing the discharge port 65.

Immediately before the shutter 70 closes the discharge port 65, the coil spring 75 (see FIG. 4) is placed in a state immediately before it is restored from the compressed state to the natural length. Accordingly, the restoration force (urged force) of the coil spring 75 is small when compared with a state immediately after the shutter 70 has started to move in the direction indicated by the arrow A (see FIG. 4). If the frictional resistance between the shutter 70 and the sealing member 76 is increased because, for example, the developer has adhered to the sealing member 76, therefore, the shutter 70 fails to completely close the discharge port. If the developing devices 2*a* to 2*d* are removed in this state, developer may leak.

Figure 11:
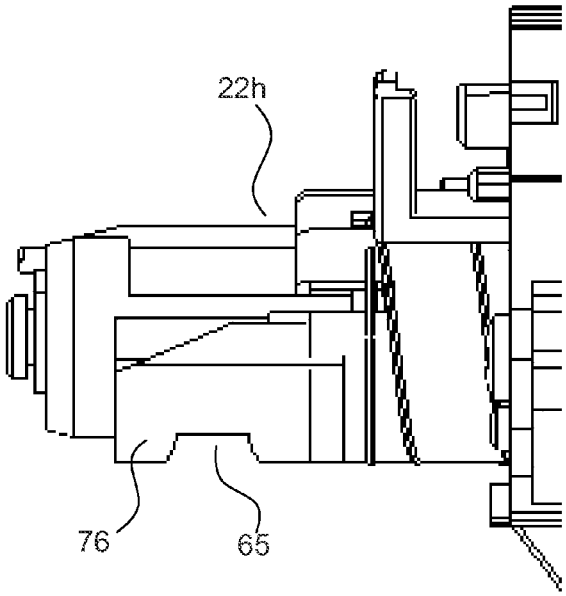
FIG. 11 is a side view of the developer discharge portion of the developing device in an embodiment of the present disclosure.
Figure 12:
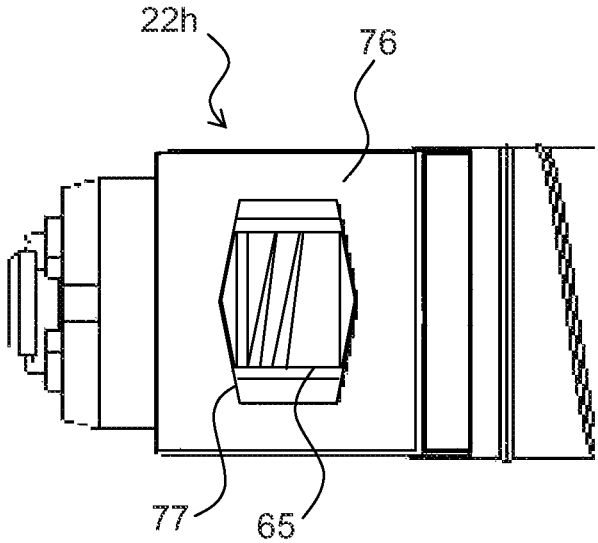
FIG. 12 is a plan view of the developer discharge portion as viewed from the discharge port.
Figure 13:
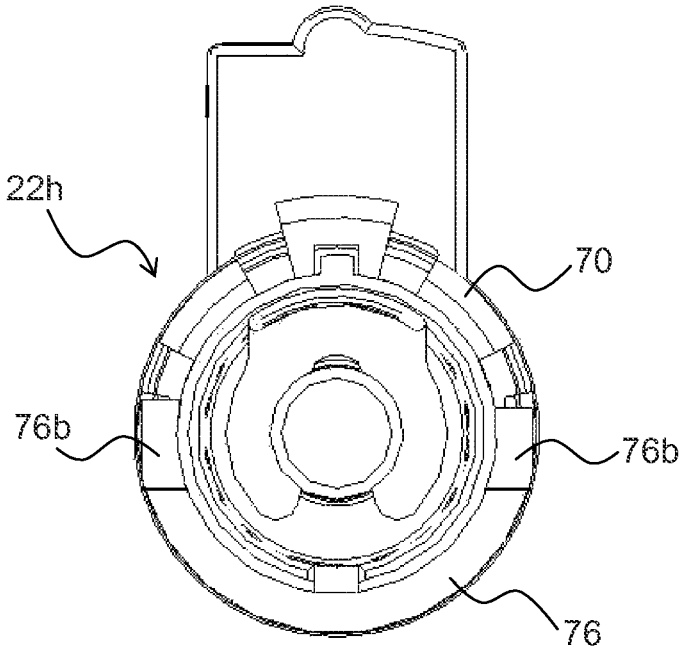
FIG. 13 is a front view of the developer discharge portion as viewed from the downstream in a direction in which a developer is discharged.
Figure 14:
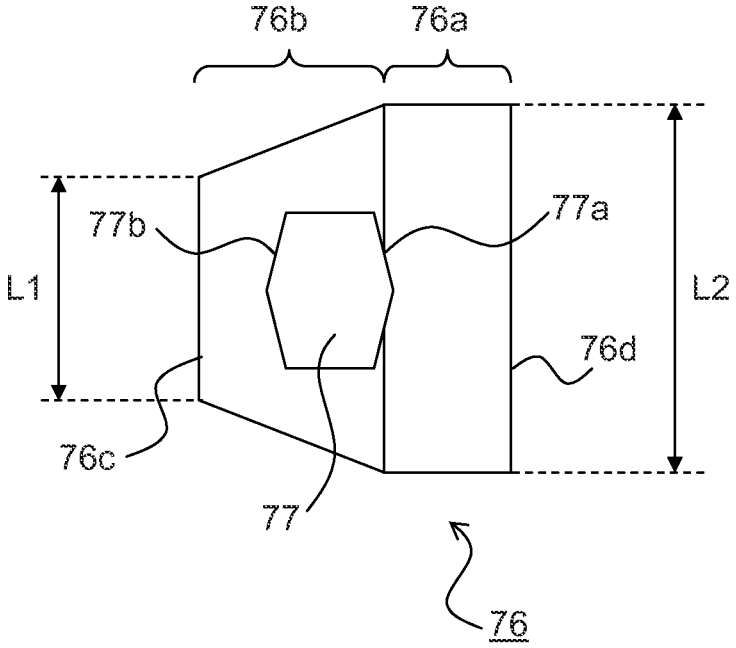
FIG. 14 is a plan view of a sealing member attached to the outer circumferential portion of the discharge port.

To solve this problem, the sealing member 76 in an embodiment of the present disclosure has a shape that reduces the frictional resistance between the shutter 70 and the sealing member 76 so that both smooth operation of the shutter 70 and adequate sealing performance are assured. FIG. 11 is a side view of the developer discharge portion 22*h* of the developing device 2. FIG. 12 is a plan view of the developer discharge portion 22*h* as viewed from the discharge port 65. FIG. 13 is a front view of the developer discharge portion 22*h* as viewed from the downstream (left side in FIG. 11) in the direction in which the developer is discharged. FIG. 14 is a plan view of a sealing member 76 attached to the outer circumferential portion of the discharge port 65. In FIG. 12, the shutter 70 is not shown.

As illustrated in FIG. 14, the sealing member 76 is hexagonally formed with a rectangular part 76*a* and a trapezoidal part 76*b*, which is a reduced part contiguous to the rectangular part 76*a*, when viewed from above. The sealing member 76 has a hexagonal opening 77, which overlaps the discharge port 65, at the center. The widthwise dimension of the trapezoidal part 76*b* between a pair of legs of the trapezoidal part 76*b* (two sides other than the bottom base and top base) is reduced as the widthwise dimension is apart from the rectangular part 76*a* (as the widthwise dimension proceeds from the right side in FIG. 14 toward the left side). Accordingly, the widthwise dimension L1 of the downstream edge 76*c* of the sealing member 76 is less than the widthwise dimension L2 of its upstream edge 76*d*. The trapezoidal part 76*b* extends in the direction in which the shutter 70 is closed (from the right side in FIG. 14 toward the left side) to the downstream edge 76*c* of the sealing member 76, starting from the upstream opening edges 77*a* of the opening 77 and proceeding beyond its downstream opening edges 77*b*. In other words, an edge, of the trapezoidal part 76*b*, that is contiguous to the rectangular part 76*a* and a portion, of the upstream opening edges 77*a*, that is at the upstream end in the direction in which the shutter 70 is closed (the rightmost portion of the upstream opening edges 77*a* in FIG. 14) are at the same position in the directions in which the shutter 70 moves (the direction toward the left side in FIG. 14 and the direction toward the right side in FIG. 14). As for an edge, of the trapezoidal part 76*b*, that is opposite to the edge contiguous to the rectangular part 76*a*, in the directions in which the shutter 70 moves (the direction toward the left side in FIG. 14 and the directions toward the right side in FIG. 14), the edge is positioned, in the direction in which the shutter 70 is closed, downstream of the downstream end at the downstream opening edges 77*b* in the direction in which the shutter 70 is closed (the leftmost portion of the downstream opening edges 77*b* in FIG. 14).

As illustrated in FIGS. 11 to 13, the sealing member 76 is stuck to the outer circumferential portion of the discharge port 65 and is secured so as to be positioned on the downstream side (left side in FIGS. 11 and 12) of the developer discharge portion 22*h* in the discharge direction. As illustrated in FIG. 13, the sealing member 76 is secured so as to overlap the lower half of the outer circumferential surface of the developer discharge portion 22*h* (180-degree range).

As the material of the sealing member 76, a nonwoven cloth, a felt, or an elastic material such as sponge can be used. In an embodiment, the sealing member 76 may be made by sticking a nylon-transplanted pile seal to a polyester foam plastic sheet. A double-faced adhesive tape may be used to secure the sealing member 76 to the outer circumferential surface of the developer discharge portion 22*h*.

Figure 15:
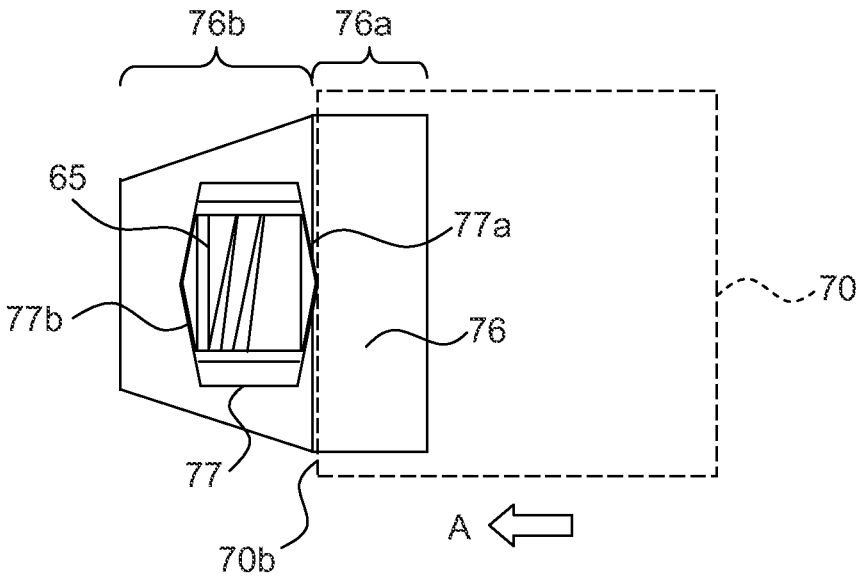
FIG. 15 is a plan view illustrating the relationship between the sealing member and an operation to close the shutter immediately after the shutter has moved in the direction indicated by the arrow A.
Figure 16:
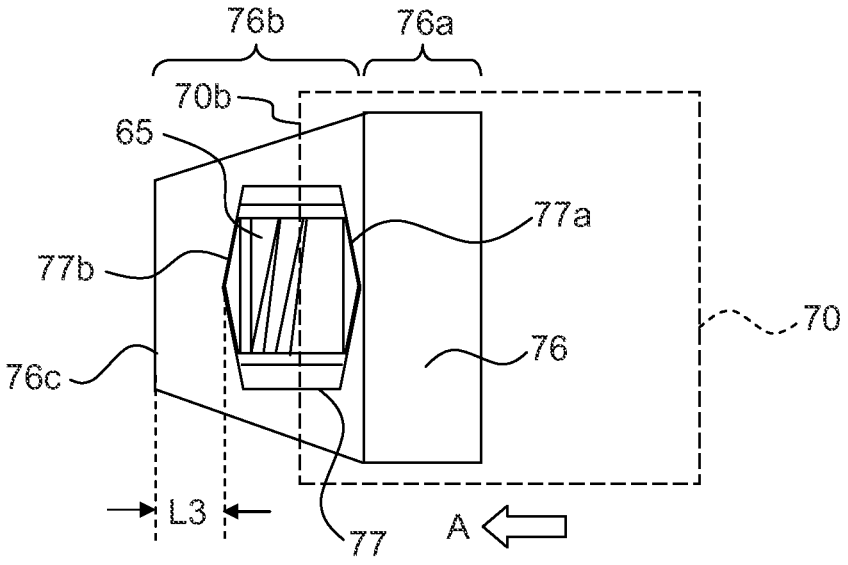
FIG. 16 is another plan view illustrating the relationship between the sealing member and the operation to close the shutter when the shutter is passing the discharge port.

FIGS. 15 and 16 are each a plan view illustrating the relationship between the sealing member 76 and an operation to close the shutter 70. The shutter 70 slides on the rectangular part 76*a* of the sealing member 76 as illustrated in FIG. 15, immediately after the shutter 70 moves in the direction indicated by the arrow A. Since the widthwise dimension of the rectangular part 76*a* is constant at L2, the area on which the shutter 70 and rectangular part 76*a* overlap each other increases at a fixed rate as the shutter 70 moves in the direction indicated by the arrow A. As a result, the load during the sliding of the shutter 70 on the sealing member 76 also increases at a fixed rate.

As illustrated in FIG. 16, when the shutter 70 then passes the opening 77, the shutter 70 slides on the trapezoidal part 76*b*. Since the widthwise dimension of the trapezoidal part 76*b* gradually reduces from L2 to L1, as the shutter 70 moves in the direction indicated by the arrow A, the ratio at which an overlapping area between the shutter 70 and the sealing member 76 increases becomes smaller when compared with the sliding of the shutter 70 on the rectangular part 76*a*. As a result, when the shutter 70 passes the opening 77, a ratio at which the load during the sliding of the shutter 70 on the sealing member 76 increases is also reduced, so it is possible to reduce the ratio at which the load during the sliding of the shutter 70 on the sealing member 76 increases at a time when the restoration force (urged force) of the coil spring 75 (see FIG. 10) is reduced.

It is also possible to reduce the ratio at which the load during the sliding of the shutter 70 on the sealing member 76 increases without having to reduce a distance L3 from the downstream ends of the downstream opening edges 77*b* of the opening 77 to the downstream edge 76*c* of the sealing member 76 in the direction in which the shutter 70 is closed (indicated by the arrow A). Accordingly, the sealing performance of the sealing member 76 at the downstream in the direction in which the shutter 70 is closed can also be assured.

Referring again to FIG. 14, the start point of the trapezoidal part 76*b* is the upstream ends of the upstream opening edges 77*a* of the opening 77 in the direction in which the shutter 70 is closed. Accordingly, since the shutter 70 starts to slide on the trapezoidal part 76*b* at a time when the shutter 70 passes the opening 77, it is possible to prevent the shutter 70 from stopping in the middle of the closing operation due to an increase in the load during the sliding of the shutter 70 on the sealing member 76, so the shutter 70 smoothly and reliably switches from a state in which the shutter 70 has opened the discharge port 65 (see FIG. 10) to a state in which the shutter 70 has closed the discharge port 65 (see FIG. 4). Accordingly, it is possible to reliably prevent developer from leaking from the discharge port 65 due to a failure of the shutter 70.

Referring again to FIG. 15, the opening 77 of the sealing member 76 is hexagonal; the downstream opening edges 77*b* of the opening 77 are not parallel to an end 70*b* of the shutter 70 but form a prescribed angle. This prevents the end 70*b* from being caught by the downstream opening edges 77*b* when the shutter 70 closes the discharge port 65.

In this example, the trapezoidal part 76*b* is formed by using the upstream ends of the upstream opening edges 77*a* of the opening 77 as the start point. However, the start point of the trapezoidal part 76*b* may be a point further upstream of the upstream opening edges 77*a* of the opening 77. In this case as well, the shutter 70 always slides on the trapezoidal part 76*b* when the shutter 70 passes the opening 77, so the load during the sliding of the shutter 70 on the sealing member 76 when the shutter 70 passes the opening 77 can be reduced.

Figure 17A:
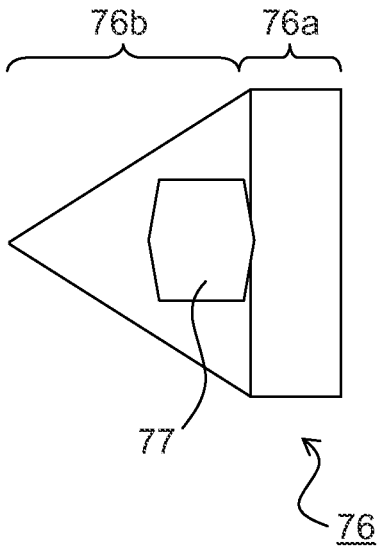
FIGS. 17A and 17B are plan views illustrating examples of other structures of the sealing member.
Figure 17B:
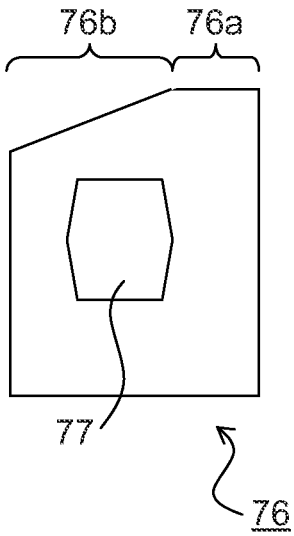

The angle formed by the side edges of the trapezoidal part 76*b* contiguous to the rectangular part 76*a* can be appropriately changed according to the frictional coefficient of the sealing member 76, the spring coefficient of the coil spring 75, the size of the opening 77, or the like. The shape of the sealing member 76 is not limited to the shape formed by the rectangular part 76*a* and trapezoidal part 76*b* as illustrated in FIG. 14; any shape can be used if the widthwise dimension is reduced from the upstream end toward the downstream end in the direction in which the shutter 70 is closed (in the direction in which the coil spring 75 is urged). For example, the sealing member 76 may be formed with the rectangular part 76*a* and a triangular part 76*b* used as the reduced part, as illustrated in FIG. 17A. Alternatively, the sealing member 76 may have a trapezoidal part 76*b* with only one side being cut at an angle, as illustrated in FIG. 17B.

The present disclosure is not limited to the embodiment described above; various modifications are possible without departing from the intended scope of the present disclosure. For example, the application of the developer transporting mechanism in the present disclosure is not limited to the developer discharge portion of the developing device 2, as illustrated in FIG. 2, which not only replenishes a two-component developer, but also discharges an extra amount of developer; the developer transporting mechanism can be applied to various portions that transport the developer through the pipe-like transporting path in the image forming apparatus. Examples of the developer transported by the developer transporting mechanism in the present disclosure include a two-component developer including toner and magnetic carriers, a one-component developer including only toner, and waste toner, which is toner collected from the image supporting body after a two-component developer has been supplied to the image supporting body.

For example, in a developer transporting mechanism in which the cleaning units 14*a* to 14*d* in FIG. 1 remove waste toner from the photosensitive drums 11*a* to 11*d* or the belt cleaning unit 31 removes waste toner from the intermediate transfer belt 17, after which the removed waste toner is transported to a waste toner vessel (not shown) by using a pipe-like path and a transporting screw, the developer transporting mechanism in the present disclosure can also be used when the developer transporting mechanism is detachably attached to the image forming apparatus 1 and a shutter that opens and closes the discharge port of the pipe-like path may be provided to prevent the waste toner from leaking.

Furthermore, the present disclosure can also be used not only in a tandem-type color printer illustrated in FIG. 1, but also to a digital or analog monochrome copier, a color copier, a facsimile machine, and other various image forming apparatuses.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses within the scope of the disclosure, in addition to those enumerated herein, will be apparent to those skilled in the art from the foregoing descriptions. Such modifications and variations are intended to fall within the scope of the appended claims. With respect to any or all of the drawings and as discussed herein, each block and/or communication may represent a process of information and/or a transmission of information in accordance with example embodiments and alternative embodiments may be included within the scope of such example embodiments.

The invention is claimed as follows:

1. A developer transporting mechanism comprising:

a pipe-like transporting path through which developer is transported, a discharge port formed at part of a side surface of the pipe-like transporting path;

a sealing member secured to an outer circumferential surface of the pipe-like transporting path, an opening that overlaps the discharge port formed in the sealing member;

a shutter that is slidable along a surface of the sealing member to open and close the discharge port; and an urging member that urges the shutter in a closing direction in which the discharge port is closed, wherein the sealing member has a reduced part that has a dimension in a width direction, orthogonal to a direction in which the shutter moves, that is gradually reduced from an upstream end in the closing direction toward a downstream end in the closing direction, and wherein the reduced part extends to a downstream edge of the sealing member in the closing direction, starting from an upstream opening edge of the opening or a point further upstream of the upstream opening edge of the opening and proceeding beyond a downstream opening edge of the opening.

2. The developer transporting mechanism according to claim 1, wherein downstream opening edges of the opening of the sealing member in the closing direction form a prescribed angle with respect to an end of the shutter.

3. A developing device comprising:

a developing vessel that holds a two-component developer including a carrier and toner;

a developer supply opening through which the two-component developer is supplied into the developing vessel;

a developer discharge portion that discharges an extra amount of two-component developer from the developing vessel; and the developer discharge portion includes a pipe-like transporting path through which the two-component developer is transported, a discharge port formed at part of a side surface of the pipe-like transporting path, a sealing member secured to an outer circumferential surface of the pipe-like transporting path, an opening that overlaps the discharge port formed in the sealing member, a shutter that is slidable along a surface of the sealing member to open and close the discharge port, and an urging member that urges the shutter in a closing direction in which the discharge port is closed, wherein the sealing member has a reduced part having a dimension in a width direction, orthogonal to a direction in which the shutter moves, that is gradually reduced from an upstream end in the closing direction toward a downstream end in the closing direction, and wherein the reduced part extends to a downstream edge of the sealing member in the closing direction, starting from an upstream opening edge of the opening or a point further upstream of the upstream opening edge of the opening and proceeding beyond a downstream opening edge of the opening.

4. An image forming apparatus comprising a pipe-like transporting path through which a developer is transported, a discharge port formed at part of a side surface of the pipe-like transporting path;

a sealing member secured to an outer circumferential surface of the pipe-like transporting path, an opening that overlaps the discharge port formed in the sealing member;

a shutter that is slidable along a surface of the sealing member to open and close the discharge port; and an urging member that urges the shutter in a closing direction in which the discharge port is closed, wherein the sealing member has a reduced part having a dimension in a width direction, orthogonal to a direction in which the shutter moves, that is gradually reduced from an upstream end in the closing direction toward a downstream end in the closing direction, and wherein the reduced part extends to a downstream edge of the sealing member in the closing direction, starting from an upstream opening edge of the opening or a point further upstream of the upstream opening edge of the opening and proceeding beyond a downstream opening edge of the opening.

5. The image forming apparatus according to claim 4, wherein downstream opening edges of the opening of the sealing member in the closing direction form a prescribed angle with respect to an end of the shutter.

6. The image forming apparatus according to claim 4, comprising a shutter position changing mechanism that changes a position of the shutter between a first position at which the discharge port is closed and a second position at which the discharge port is opened;

the shutter position changing mechanism includes an urging member that urges the shutter in the closing direction; and a pressing member that presses the shutter in an opening direction in which the discharge port is opened against an urged force exerted by the urging member.

* * * * *